US007971453B2

(12) United States Patent
Horn et al.

(10) Patent No.: US 7,971,453 B2
(45) Date of Patent: Jul. 5, 2011

(54) KNITTING MACHINE NEEDLE WITH LOSS-PROOF COUPLING COMPONENT

(75) Inventors: Kuno Horn, Nusplingen (DE); Jurgen Schneider, Balingen-Frommern (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 12/848,585

(22) Filed: Aug. 2, 2010

(65) Prior Publication Data

US 2011/0023553 A1 Feb. 3, 2011

(30) Foreign Application Priority Data

Aug. 3, 2009 (EP) ..... 09167092

(51) Int. Cl.
*D04B 35/02* (2006.01)

(52) U.S. Cl. ..... 66/123; 66/116

(58) Field of Classification Search ..... 66/221, 66/116, 123, 120, 121, 216, 218, 219, 22, 66/75.1, 75.2

See application file for complete search history.

(56) References Cited

U.S. PATENT DOCUMENTS

| | | | | |
|---|---|---|---|---|
| 2,025,462 | A * | 12/1935 | Lombardi | 66/216 |
| 3,678,710 | A * | 7/1972 | Gostelow | 66/14 |
| 3,779,042 | A * | 12/1973 | Reagan | 66/223 |
| 6,178,786 | B1 * | 1/2001 | Willmer | 66/221 |
| 6,705,130 | B2 * | 3/2004 | Weihing et al. | 66/123 |
| 7,836,730 | B1 * | 11/2010 | Pai | 66/123 |
| 2006/0016227 | A1 | 1/2006 | Simmendinger et al. | |

FOREIGN PATENT DOCUMENTS

| | | |
|---|---|---|
| DE | 1965385 | 7/1971 |
| DE | 4441389 | 6/1996 |
| EP | 1619282 | 1/2006 |
| WO | 2009013773 | 1/2009 |

* cited by examiner

*Primary Examiner* — Danny Worrell
(74) *Attorney, Agent, or Firm* — Fitch, Even, Tabin & Flannery; Norman N. Kunitz

(57) ABSTRACT

In order to simplify handling of the knitting machine needles and of associate coupling members—in particular when loading the rib dials—a knitting machine needle with a coupling member that is pivotally supported on said knitting machine needle is being provided. The transverse bearing surfaces (21*a*) and (*b*), as well as (22*a*) and (*b*), said surfaces being at least temporarily in abutment with each other, are disposed to laterally secure the coupling member (3) on the needle body.

14 Claims, 3 Drawing Sheets

KNITTING MACHINE NEEDLE WITH LOSS-PROOF COUPLING COMPONENT

CROSS-REFERENCE TO RELATED APPLICATION

The present application claims the priority of European Patent Application No. 09 167 092.7, filed Aug. 3, 2009, the subject matter of which, in its entirety, is incorporated herein by reference.

BACKGROUND OF THE INVENTION

The invention relates to a knitting machine needle, in particular to a rib dial needle.

In particular considering small circular knitting machines, conditions are restricted around the rib dial. The rib dial forms an annular bed for the accommodation of the rib dial needles that are also referred to as rib needles. Such a small circular knitting machine has been disclosed by WO 2009/013773 A1, for example. The knitting machine described therein comprises a knitting cylinder with vertically arranged cylinder needles and a rib dial with horizontally arranged rib needles. The rib needles are moved by a needle selecting mechanism that is located above the rib dial. The needle selecting mechanism acts on the rib needles by way of pivotally supported selecting members.

Needle selecting systems of this type do not comprise a fixed connection between the selecting members and the rib needles. The selecting members can only shift the rib needles in a radially outward direction. In addition, there is the risk that even a minimal lateral deflection of the selecting member can cause the needle foot to be missed by said selecting member and the needle to be activated in an improper manner. Furthermore, loading the small circular knitting machine requires considerable manual effort because the selecting members and the rib needles must be handled separately.

In addition, connections have also been known in knitting machines, wherein, for example, a knitting machine needle is connected with a selecting or coupling member, such a connection potentially enabling a pivoting movement of the selecting or coupling member. These connections are severable connections that preferably can be severed relative to the transverse direction to the longitudinal axis of the knitting machine needle. As a result of this, assembly as well as disassembly of the knitting machine needle and of the selecting member or coupling member can be difficult.

Considering this, it is the object of the invention to provide a knitting machine needle, in particular a rib dial needle, said needle displaying a form-fitting connection between the selecting member and the rib needle.

SUMMARY OF THE INVENTION

The above object generally is achieved according to the invention with a knitting machine needle having a needle body that is connected with a selecting member. The selecting member may also be configured as a coupling member. The connection used is a hinge arrangement or joint arrangement that, in one embodiment, comprises a coupling recess on the needle and a dial head arranged on the coupling member. Referring to another embodiment, the coupling recess is provided on the coupling member, whereas the dial head is formed on the needle body. In both cases, the dial head has a bearing surface on its circumference, said bearing surface being associated with a counter bearing surface provided on the coupling recess. As a result of this arrangement of the bearing surface and the counter bearing surface it is possible to achieve a precise, smooth-moving bearing with minimal play. Good force transmission from the coupling member to the needle body is achieved in longitudinal direction of the needle body, as well as in the driving-out direction and also in the retracting direction.

Preferably, the bearing surface of a coupling recess circumscribes a dial head on it circumference at least on three sides and thus forms a joint arrangement. The three-sided enclosure is achieved in that the bearing surface extends by an angle of more than 180° around the swivel axis of the joint. In so doing, the dial head is secured in the recess in each direction, radially with respect to the swivel axis.

The hinge arrangement formed by the dial head and the coupling recess defines a swivel axis. The swivel axis is oriented in a Z-direction that is to be understood in a direction transverse to the needle body. The longitudinal direction of the needle body is viewed as the X-direction. At a right angle to the X-direction, as well as to the Z-direction, a Y-direction is defined, said Y-direction also being referred to as the height direction. In at least one swivel position, the coupling member extends in this height direction or Y-direction. Depending on the installation situation, the coupling member may also extend in a direction different from the Y-direction.

By configuring the hinge arrangement in the form of a dial head and an associate coupling recess, the coupling member is mostly coupled with the needle body in an X-direction. In order to ensure no loss in Z-direction, matching transverse bearing surfaces, said surfaces being at least temporarily in abutment with each other, are provided on the coupling member and on the needle body. These transverse bearing surfaces are in abutment with each other, at least when the coupling member and the needle body are in a swivel position relative to each other as is assumed when the coupling member and the needle are to be mounted in the rib dial or another in needle bed. For example, this is a position in which the coupling member is slightly inclined toward the height direction. This measure prevents the coupling member and the needle body to unintentionally fall apart during assembly, i.e., during installation in the needle bed. Handling of the unit consisting of the needle body and the coupling member is facilitated considerably.

The coupling recess may be a C-shaped recess. Thus, in sections, its contour follows a circular arc. In the case of a U-shaped recess, it is possible—in principle—for a coupling member and the needle body to fall apart in Y-direction. Considering the C-recess, coupling between the needle body and the coupling member, as well as coupling in X-direction and Y-direction are a given. In both cases, coupling in Z-direction is accomplished by the transverse bearing surfaces.

The transverse bearing surfaces may be located inside the dial head and in the region delimited by the coupling recess or outside said recess. This applies to the arrangement of the dial head on the coupling member as well as to embodiment in which the dial head is arranged on the needle body. If the transverse bearing surfaces are arranged in the region delimited by the coupling recess, the dial head is preferably divided in longitudinal direction. Thus, said dial head comprises two head halves that may be symmetrically arranged relative to the X-Y plane. In this case, the dial head may be secured by a projection on a wall extending in Y-direction between the head halves of said head, said projection extending, for example, from one head half into an opening of the centrally arranged wall. Preferably, the projection has sufficient play in the opening to cause the swivel bearing action to be achieved not only by the projection and the opening but only by the bearing surface and the counter bearing surface.

Additional details of advantageous embodiments of the invention are the subject matter of the drawings, the description, or the claims. The description is restricted to essential aspects of the invention and miscellaneous situations. The drawings disclose additional details and are to be considered supplementary.

DETAILED DESCRIPTION OF THE INVENTION

Figure 1A:
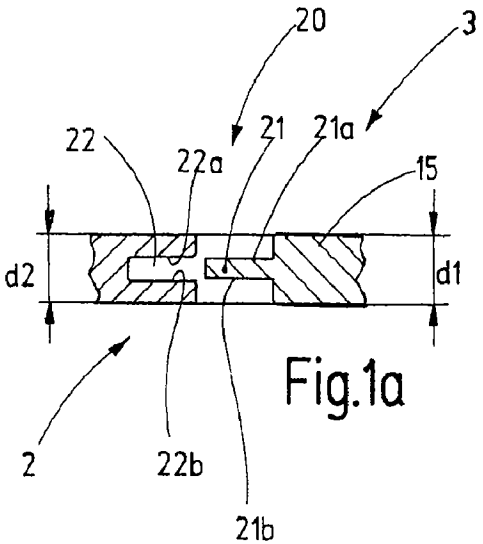
FIG. 1*a* is a horizontal sectional view of a detail of a section of the knitting machine needle as in FIG. 1.
Figure 1:
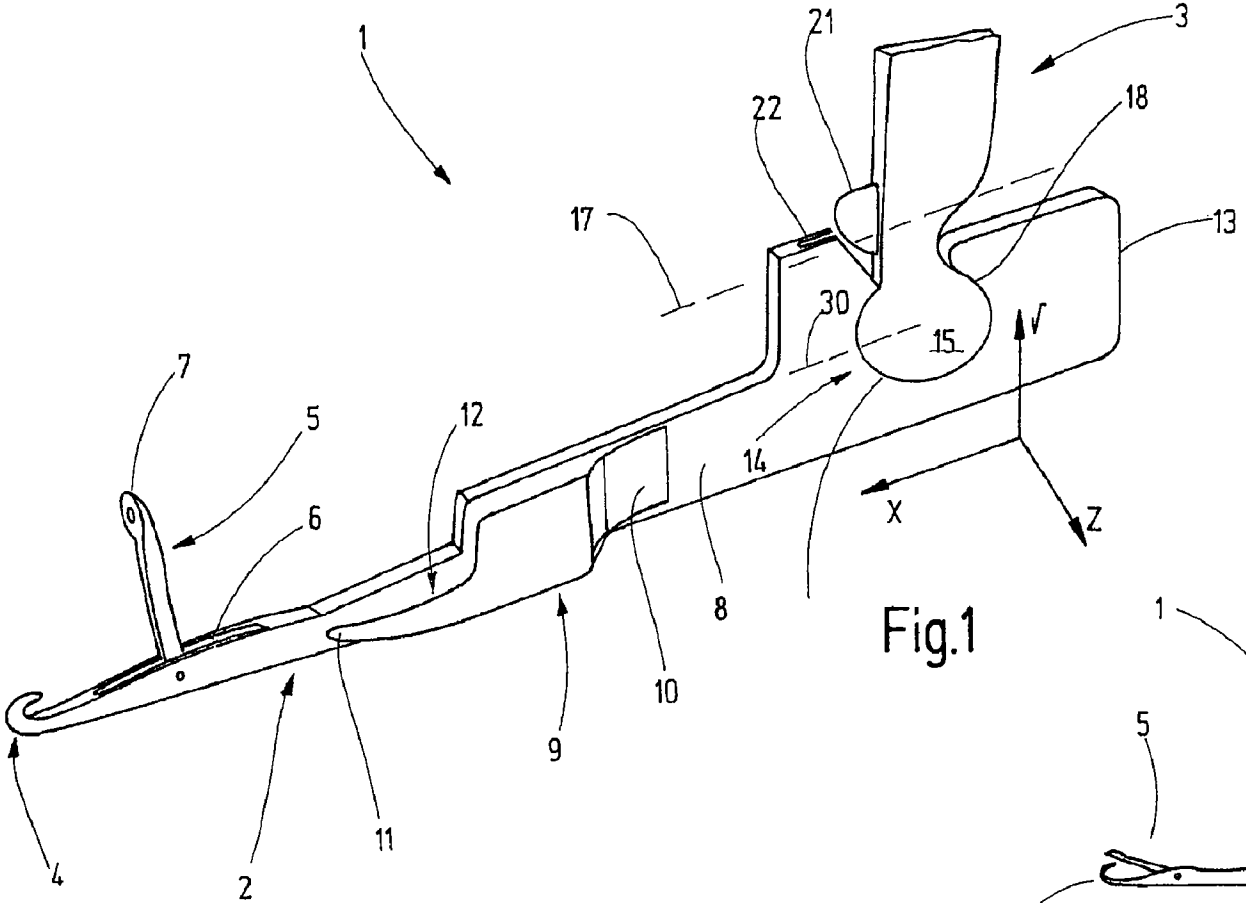
FIG. 1 is a perspective representation of a knitting machine needle with its associate coupling member shown in sections.

FIG. 1 shows a knitting machine needle 1 that is prepared for installation in a rib dial and may thus be referred to as a rib dial needle or a rib needle. However, the invention is not restricted to rib needles but can also be used on knitting machine needles that are not inserted in the rib dials.

The knitting machine needle 1 comprises a needle body 2 and a coupling member 3. Preferably, the needle body 2 is configured as an elongated flat part. On one end, said elongated flat part is provided with a hook 4 that is disposed to form stitches. The hook 4 may be associated with additional elements such as, for example, a latch 5 that is pivotally supported near the hook 4. This latch is pivotally supported in a latch slit 6 so that its end 7 can cover the point of the hook 4 and thus close the hook 4 or—also in rear position—can reach a position remote from the hook 4 in order to clear the hook 4.

A rehanging spring 9 may be provided on one flank 8 of the needle body 2, one end 10 of said spring being firmly held on the needle body 2. Its point 11 can abut against the flank 8 or the bottom of an indentation provided there. Preferably, a reeding space 12 is defined between the rehanging spring 9 and the flank 8 of the needle body 2, whereby another needle may pierce through said reeding space for stitch take-over.

The needle body 2 extends from the rehanging spring 9 to an end 13 remote from the hook 4. A hinge arrangement 14 is formed between the end 13 and the rehanging spring 9, said hinge arrangement 14 being configured so as to pivotally support the coupling member 3 on the needle body 2. This hinge arrangement 14 defines a swivel axis that coincides with the Z-direction and is thus oriented parallel to the swivel axis of the latch 5. To illustrate this, the directions X, Y and Z are shown in FIG. 1. The X-direction coincides with the longitudinal direction of the needle body 2. The Z-direction is the corresponding transverse direction, and the Y-direction is the corresponding height direction. To add to the understanding of this, reference is made to FIG. 2 that shows a simplified isometric side view with the corresponding coordinate directions X and Y.

The hinge arrangement 14 comprises a dial head 15 and a matching coupling recess 16. The dial head 15 is provided on the coupling member 3 and is thus referred to as the coupling dial head 15. The coupling recess 16 is provided on the needle body 3 and is thus referred to as the needle coupling recess 16. Preferably, the dial head 15 is a circular dial. In other words: Its contour follows a circular arc over more than 180°. It is possible for this circular arc to be made discontinuous with (not illustrated) recesses. The coupling recess 16 is a C-shaped recess. Its contour follows a circular arc having a radius that is only unsubstantially greater than the radius of the contour of the dial head 15. The dial head 15 has flat sides at a distance from each other in Z-direction, said distance defining the thickness D1 of the dial head 15. The section of the needle body 2 circumscribing the coupling recess 16 also has flat sides, the distance of said flat sides defining the thickness D2 of the needle body in this region. This thickness D2 corresponds to the aforementioned thickness D1. For clarification, reference is made to FIG. 1*a* that shows a horizontal section through the knitting machine needle 1 in accordance with FIG. 1 approximately on the height of the dashed line 17. Approximately the height of the line 30, the thickness ratios are also comparable below this line 17.

On its outside circumference, the coupling dial head 15 is provided with a counter bearing surface 18. It follows a circular arc and is thus cylindrical or partially cylindrical. However, it may also be ball-shaped or slightly conical.

Figure 2:
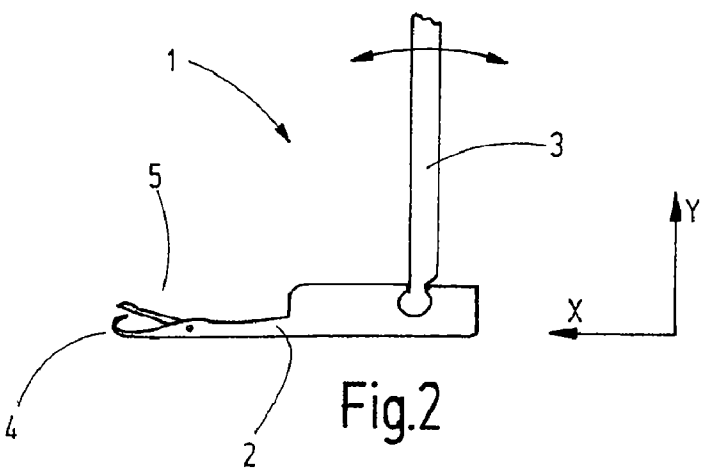
FIG. 2 is a schematic side view of the knitting machine needle as in FIG. 1, with the selecting member.
Figure 3:
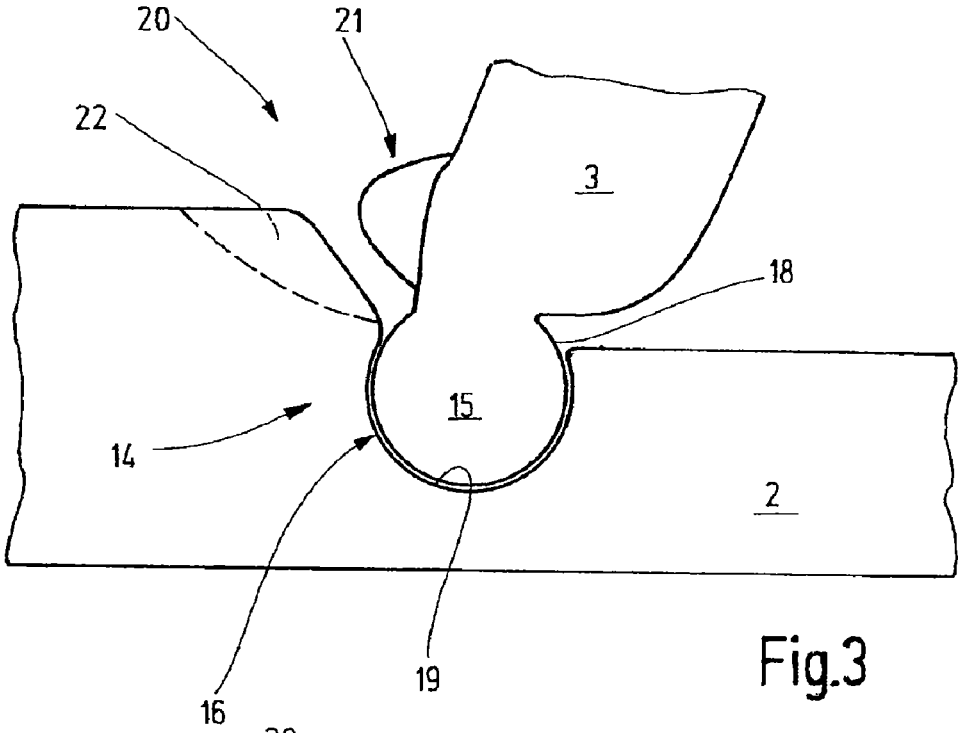
FIG. 3 is a side view of a section of the knitting machine needle as in FIG. 1.

The associate needle coupling recess 16 has a bearing surface 19 that circumscribes the counter bearing surface 18 (FIG. 3). As a result of this, the coupling dial head is supported with minimal play in the needle coupling recess 16. During a swivel movement of the coupling member 3, the counter bearing surface 18 is guided by the bearing surface 19. A transverse securing means 20 are arranged on the hinge arrangement 14 or in the vicinity thereof. Said transverse securing means is disposed to hold the coupling dial head 15 in a loss-proof manner in the needle coupling recess 16 when the knitting machine needle 1 is removed from the needle bed, i.e., for example the rib dial. In the present exemplary embodiment, the transverse securing means 20 comprises a lug 21 formed on the coupling member 3, the thickness of said lug being smaller in Z-direction than the thickness D1 of the coupling member 3, said thickness D1 being measured in the same direction. Here, for example, the lug 21 is associated with a recess having the form of a slit 22 on the needle body 2, said slit being disposed to accommodate the lug 21. For further clarification, reference is also made to FIG. 1*a* in conjunction with this. The slit 22 may be provided in the vicinity of or directly adjoining the needle coupling recess 16. Preferably, in so doing, the spatial association is such that the lug 21 is positioned in the slit 22 when the coupling member 3 is inclined slightly to the left, i.e., toward the hook 4, in an assembly/disassembly position, assuming the position as in FIG. 2. Preferably, the lug 21 has two flat transverse bearing surfaces 21*a*, 21*b*, said surfaces being arranged parallel to each other. Preferably, the slit 22 is delimited by two transverse bearing surfaces 22*a*, 22*b* that are parallel to each other. When the lug 21 is positioned in the slit 22, the transverse bearing surfaces 21*a*, 21*b* abut against the transverse bearing surfaces 22*a*, 22*b* in Z-direction.

Preferably, the lug 21 and the slit 22 are arranged, relative to the needle body 2 and to the coupling member 3, so as to be centered and symmetrical relative to the center plane extending in X-direction and Y-direction.

The dimensions of the lug 21 and its associate slit 22 may be such that—in the assembly/disassembly position between the transverse bearing surface 21*a*, 21*b* of the lug 21 and its associate transverse bearing surface 22*a*, 22*b* of the slit 22—a frictional fit is created and thus the coupling member 3 is in frictional engagement with the needle body 2. In addition, it is possible for the transverse bearing surfaces 21*a* and 21*b* to be conically arranged so as to extend toward each other at an acute angle and thus for the thickness of the lug 21 to decrease in the direction of its tip. Then, the slit 22 may be configured so as to be congruent to the lug 21, whereby the opening of the slit's point associated with the lug 21 has a greater width than the slit base. Consequently, the lug 21 may be easily inserted in the Slit 22. In order to affect the frictional fit between the needle 21 and the slit 22, it is possible for the conicity of the lug 21 and of the slit 22 to greatly deviate from each other and to be configured with different thicknesses.

During operation of the knitting machine needle 1, said needle can be moved back and forth in X-direction by means of a corresponding movement of the coupling member. In so doing, the coupling member 3 can perform a swiveling movement in order to shift the needle body 1 forward or backward to accomplish the knitting operation in X-direction. In so doing, the coupling dial head 15 performs a limited rotational movement inside the needle coupling recess 16. In so doing, the conditions may be such that the lug 21 is permanently positioned inside the slit 22. However, it is also permissible for the lug 21 to leave the slit 22. Inside the needle bed, i.e., the rib dial, the coupling member 3 and the needle body 2 are held together by the flanks of the respective needle channel, provided it has been ensured that the hinge arrangement 14 does not leave the needle channel.

If, however, the hinge arrangement 14 leaves the needle channel, the lug 21 will have previously immersed into the slit 22 in order to thus ensure the connection between the coupling member 3 and the needle body 2 in Z-direction. This connection is also given when the needle body 2 and the coupling member 3 have been removed from the rib dial, for example, for disassembly.

Different from the depictions in FIGS. 1 through 3, the lug 21 may also be part of the needle body 2, in which case the slit 22 is provided on the coupling member 3. In so doing, it is possible to arrange the combination of lug 21 and slit 22 both on the side of the coupling member 3 facing the hook 4, similarly as shown in FIG. 1, and on the rear side facing the end 13. Likewise, two lugs 21—one on the side facing the hook 4 and one on the opposite side facing the end 13—may be provided on the coupling member 3, in which case the corresponding slits 22 may then be provided on both sides of the hinge arrangement 14 in order to accommodate the respective lug 21. Also, it is possible to provide lugs 21 on the needle body 2 on both sides of the hinge arrangement 14, said lugs coming into engagement with corresponding slits 22 of the coupling member 3.

Figure 4:
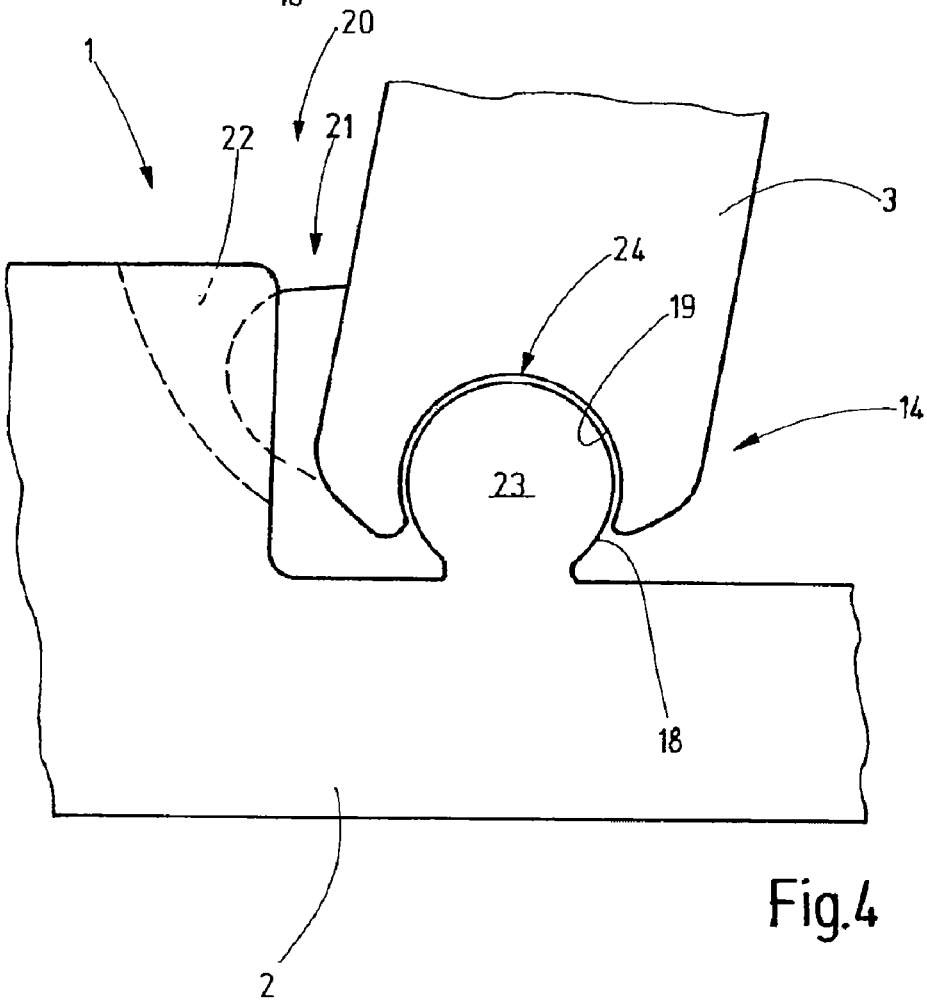
FIG. 4 is a side view of a section of a modified embodiment of the knitting machine needle in accordance with the invention.

FIG. 4 shows another modified embodiment of the knitting machine needle 1 in accordance with the invention. This embodiment is different in view of the design of the hinge arrangement 14. Now, the dial head is associated with the needle body 2, which is why, in this case, it is referred to as the needle dial head 23. Here, the coupling recess is associated with the coupling member 3, which is why, in this case, it is referred to as the coupling member coupling recess 24. The above description applies analogously considering all the remaining features and variations, in particular in view of the counter bearing surface 18, the bearing surface 19, the lug 21 and the associate slit 22.

In each of the above-described embodiments the transverse securing means 20 is located outside the hinge arrangement 14. However, in each of these embodiments it is equally possible to arrange the transverse securing means 20 inside the hinge arrangement 14. This will be explained with reference to an example of an embodiment in accordance with FIG. 5. The coupling recess is only configured in an exemplary manner as the needle coupling recess 16'. Its counter bearing surface 18 follows a curvature having the form of a circular arc for about approximately 180°. This is a U-shaped coupling recess. Approximately in the center inside the needle coupling recess 16', there is a wall 25, said wall being preferably arranged approximately in the center and parallel to the X-Y plane; the coupling dial head 15 is divided into the head halves 15*a*, 15*b* that—between them—form a head slit 26. Preferably, the head slit 26 has a slit width that is minimally greater than the thickness of the wall 25, as is also obvious, for example, from FIG. 6.

Figure 5:
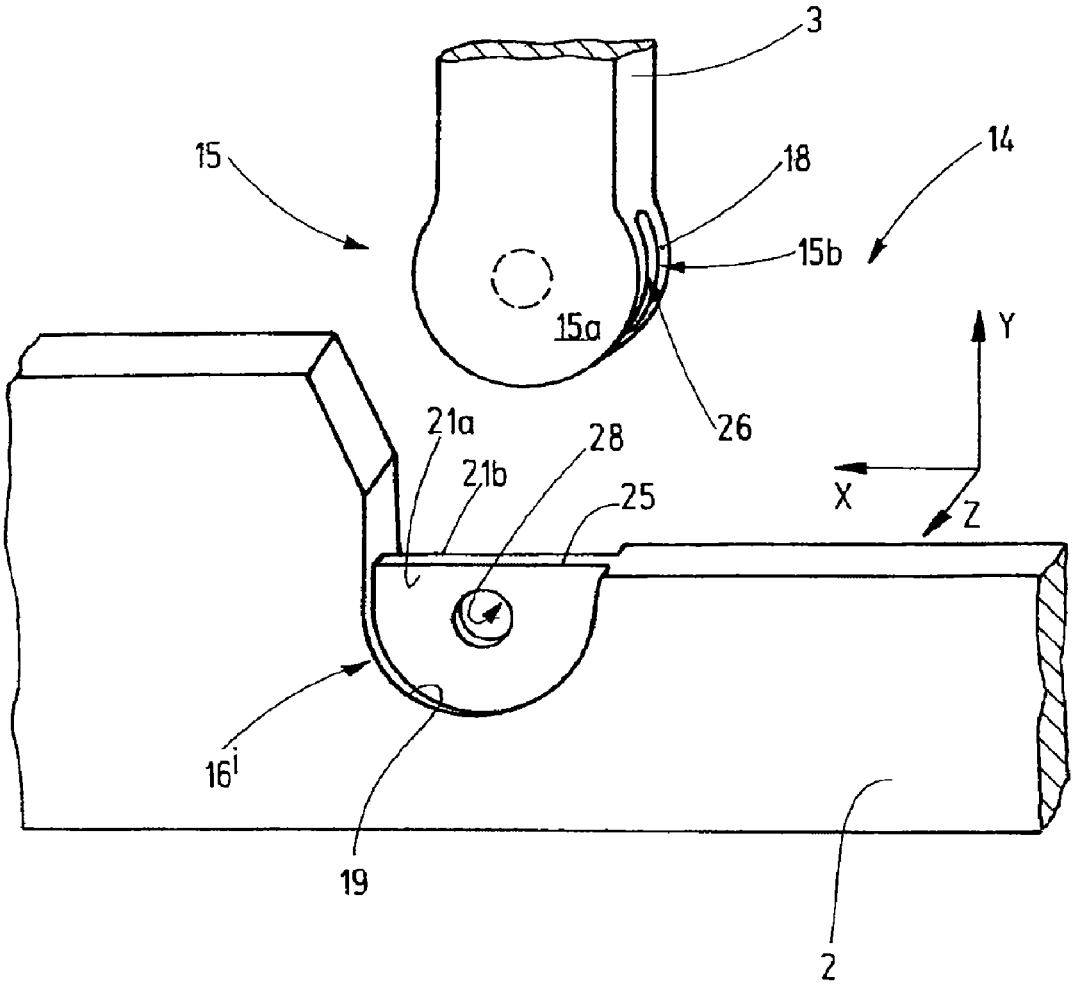
FIG. 5 is a perspective exploded view of a section of another modified embodiment of the knitting machine needle in accordance with the invention.
Figure 6:
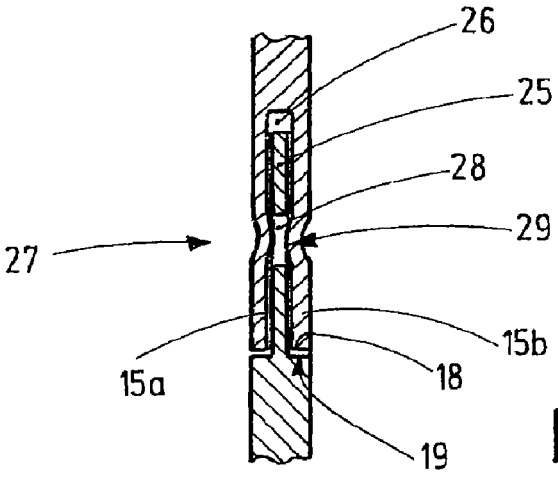
FIG. 6 is a vertical cross-sectional view of a section of the knitting machine needle as in FIG. 5.

While, in each of the previously described embodiments, coupling is accomplished between the coupling member 3 and the needle body 2 in that the bearing surface 19 extends by more than 180° around the respective dial head 15 or 23, i.e., a C-shaped coupling recess is being formed, securing is accomplished in Y-direction in the embodiment as in FIG. 5 by means of a securing means 27 that comprises an opening 28 provided in the wall 25. Preferably, the opening 28 is fixed in position concentrically to the rotational or swivel axis (hinge axis) defined by the counter bearing surface 18 and the bearing surface 19. At least one of the head halves 15*a*, 15*b*, preferably both, are provided at the opening 28 with a projection extending into the opening 28. This can be achieved by a corresponding local plastic deformation of the head halves 15*a*, 15*b*, as indicated in FIG. 6. The projection 29 shown there at the head half 15*b* is created, for example, by an inward directed plastic deformation in this region of the head half 15*b*. Preferably, the projection 29 and the opening 28 do not act as bearings and thus not for defining a hinge axis but act only as a securing means. In contrast, the swivel bearing is formed by the counter bearing surface 18 and the bearing surface 19.

This type of securing means using the central wall 25, the opening 28 and the corresponding projections 29 can also be applied to each of the above-described embodiments if U-shaped coupling recesses are to be provided instead of the C-shaped coupling recesses 16, 24.

In order to simplify handling of the knitting machine needles and of associate coupling members—in particular when loading the rib dials—a knitting machine needle with a coupling member that is pivotally supported on said knitting machine needle is being provided. The transverse bearing surfaces 21*a* and *b*, as well as 22*a* and *b*, said surfaces being at least temporarily in abutment with each other, are disposed to laterally secure the coupling member 3 on the needle body.

It will be appreciated that the above description of the present invention is susceptible to various modifications, changes and modifications, and the same are intended to be comprehended within the meaning and range of equivalents of the appended claims.

LIST OF REFERENCE CHARACTERS

1 Knitting machine needle
2 Needle body
3 Coupling member
4 Hook
5 Latch
6 Latch slit
7 End
8 Flank
9 Rehanging spring
10 End

11 Point
12 Reeding space
13 End
14 Hinge arrangement
15 Coupling dial head
15*a*, 15*b* Head halves
16, 16' needle coupling recess
17, 30 Line
18 Counter bearing surface
19 Bearing surface
20 Transverse securing means
21 Lug
21*a*, 21*b* Transverse bearing surfaces
22 Slit
22*a*, 22*b* Transverse bearing surfaces
23 Needle dial head
24 coupling member coupling recess
25 Wall
26 Head slit
27 Securing means
28 Opening
29 Projection

What is claimed is:

1. Knitting machine needle comprising:

a needle body, said needle body being provided with a hook and having, at a location at a distance from the hook, one of (a) a needle coupling recess enclosed by a bearing surface, and a needle dial head having a bearing surface on a circumference of said needle dial head;

a coupling member having, on one end, one of a coupling dial head matching the needle coupling recess and having, on its circumference, a counter bearing surface, and (b) a coupling member coupling recess enclosed on three sides by a bearing surface and matching the needle dial head; and wherein matching transverse bearing surfaces are provided on the coupling member and on the needle body, said bearing surfaces being at least temporarily in abutment with each other, and being oriented transversely with respect to the bearing surfaces and the counter bearing surfaces with at least one of the transverse bearing surfaces being arranged at a region enclosed by the needle coupling recess or by the coupling member coupling recess.

2. Knitting machine needle as in claim 1, wherein the needle coupling recess is a C-shaped or U-shaped recess.

3. Knitting machine needle as in claim 1, wherein the coupling dial head is a circular dial head.

4. Knitting machine needle as in claim 1, wherein the coupling member coupling recess is a C-recess or a U-recess.

5. Knitting machine needle as in claim 1, wherein the needle dial head is a circular dial head.

6. Knitting machine needle as in claim 1, wherein one of (a) the coupling dial head together with the needle coupling recess and (b) the needle dial head together with the coupling member coupling recess forms a joint arrangement with a swivel axis that is oriented transversely with respect to the knitting machine needle.

7. Knitting machine needle as in claim 1, wherein the transverse bearing surface is formed on a wall arranged in the enclosed region.

8. Knitting machine needle as in claim 7, wherein the dial head supported in the coupling recess consists of two head halves, between which a head slit is formed for the accommodation of the wall.

9. Knitting machine needle as in claim 8, wherein the dial head is secured on the wall by a radial securing means.

10. Knitting machine needle as in claim 9, wherein the radial securing means is formed by at least one projection that extends from one head half into an opening in the wall.

11. Knitting machine needle as in claim 1, wherein at least one of the transverse bearing surfaces is arranged outside the region enclosed by a respective one of the needle coupling recess and the coupling member coupling recess.

12. Knitting machine needle as in claim 1, wherein at least one of the transverse bearing surfaces is provided with a lug, said lug being arranged on one of the coupling member and the needle body.

13. Knitting machine needle as in claim 12, wherein the lug is associated with a slit, said slit being provided in one of the needle body and the coupling member.

14. Knitting machine needle as in claim 1, wherein the dial head, the coupling member and the needle head have uniform matching thicknesses.

* * * * *